United States Patent [19]

Babson

[11] Patent Number: 4,639,242

[45] Date of Patent: Jan. 27, 1987

[54] VESSEL AND PROCEDURE FOR AUTOMATED ASSAY

[76] Inventor: Arthur L. Babson, Old Mill Rd., Chester, N.J. 07930

[21] Appl. No.: 698,013

[22] Filed: Feb. 4, 1985

[51] Int. Cl.[4] ..... B04B 1/00; B65D 23/00

[52] U.S. Cl. ..... 494/37; 215/1 R; 494/43

[58] Field of Search ..... 494/16, 20, 17, 18, 494/43, 56, 57, 58, 59, 37; 215/1 R, 1 C, 99.5; 422/72, 100, 102

[56] References Cited

U.S. PATENT DOCUMENTS 1,019,022 3/1912 Cadwell ..... 215/1 R 2,009,690 7/1935 Flowers ..... 494/16

3,513,976 5/1970 James ..... 494/16

FOREIGN PATENT DOCUMENTS 282440 8/1952 Switzerland ..... 494/16

*Primary Examiner*—Robert W. Jenkins

*Attorney, Agent, or Firm*—George M. Yahwak

[57] ABSTRACT

The present invention relates generally to a unique vessel for separating a liquid from a solid phase in a single and convenient unit and, more particularly to a reaction vessel which may be used for conducting a number of different chemical and immunoassay methodologies.

20 Claims, 4 Drawing Figures

VESSEL AND PROCEDURE FOR AUTOMATED ASSAY

A number of procedures in the clinical laboratory require centrifugation. Examples include clarification of samples by removal of sediments or cells and removal of interfering proteins by specific precipitating reagents. In such cases the desired supernatant solution is normally decanted from the centrifuge tube to a clean tube for further processing. The present invention allows complete physical separation of the precipitate and supernatant solution in a single tube so that the supernatant solution can be further treated or sampled as by pipetting without disturbing the precipitate.

Hydrolytic enzymes can be measured by their action on insoluble substrates or soluble substrates that can be precipitated and separated from soluble products of hydrolysis. These assays can be performed in vessels of the present invention with fewer steps and/or reagents than is customarily used.

Radioimmunoassay (RIA) is a sensitive procedure for quantitating a variety of analytes of clinical importance. It is based on the competition between added radiolabelled analyte and analyte in the sample for limited binding sites on specific antibody in the reagent. The binding of radiolabelled analyte is inversely related to the concentration of analyte in the sample. The bound radioactivity can be separated from the unbound fraction by a variety of means such as precipitation with second antibody, polyethylene glycol or ammonium sulphate followed by centrifugation. The radioactivity in either the bound or unbound fraction is then counted. Alternatively, a fluorescent or enzyme label can be used rather than a radiolabel. These labels would require a different measuring instrument. However, the assay principle is the same. Quantitation of the assay is provided by reference to standards to known analyte concentration run as samples.

With immunosassays for analytes in very low concentrations the reactions take a long time to reach equilibrium. Quantitative results can be achieved without waiting for equilibrium conditions only if timing of the reactions is precisely controlled. Centrifugation is a batch process in which all tubes are processed simultaneously. Precise timing of reactions would require simultaneous addition of reagents to all tubes which is impractical.

Centrifugal analyzers have provided a means for the simultaneous initiation of multiple assays, and these instruments have found widespread use in the clinical laboratory of kinetic assays such as enzyme determinations. They are not well suited to the separation of precipitates as is required in conventional immunoassay procedures.

In order to automate immunoassays involving centrifugation, particularly those that require precise timing of all steps in the analysis, each reaction tube must be centrifuged sequentially in the same order and timing sequence that reagents were added. The present invention provides for that possibility.

Another approach to immunoassay employs specific antibody bound to the lower inside surface of the reaction tube. After a prolonged incubation of sample with radiolabelled analyte owing to the dependence on diffusion for antigen-antibody reactions, the contents of the tube are discarded, the tube washed to remove traces of unbound analyte, and the bound radioactivity on the tube counted. An automated version of the coated tube immunoassay has been developed by Micromedic Systems, Horsham PA (CONCEPT 4 TM) which is cumbersome and requires long incubation times. A simpler procedure requiring shorter incubation times would be provided by the present invention.

The objects, advantages, and principles of the present invention and the preferred embodiments thereof will best be understood by reference to the accompanying drawings in which.

Figure 1:
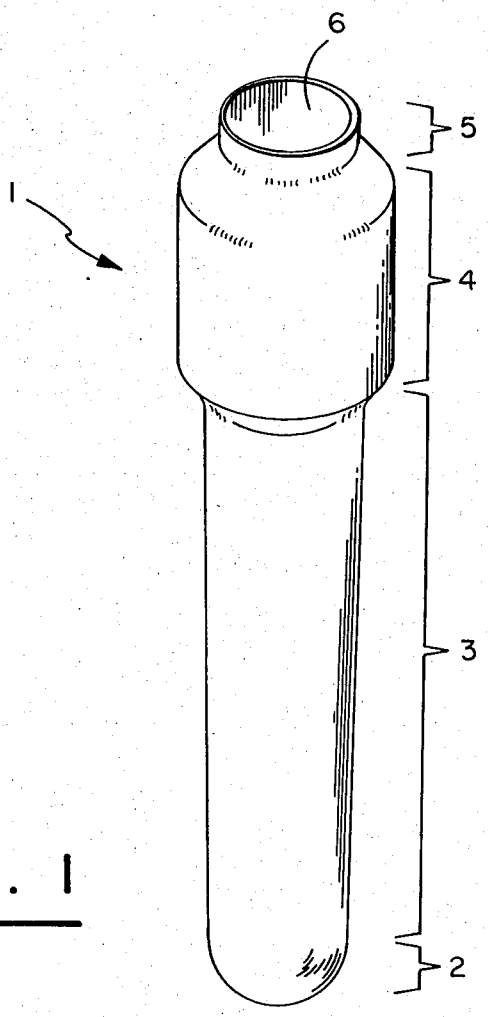
FIG. 1 is a perspective view of a reaction vessel incorporating the teachings of the present invention.
Figure 4:
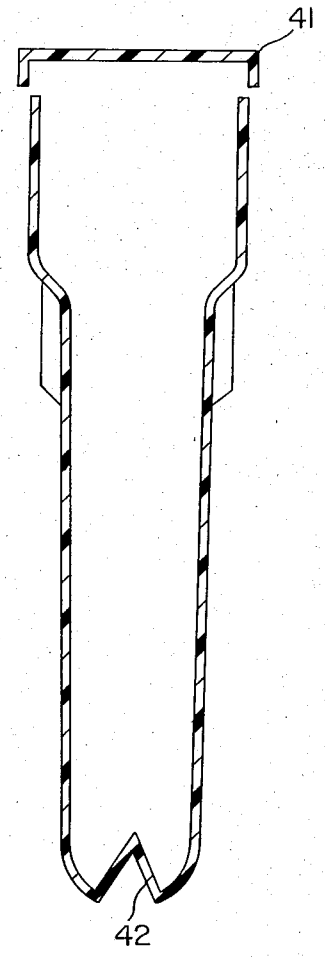
FIG. 4 is a longitudinal cross-sectional view of the reaction vessel of FIG. 3.

With regard to FIG. 1, there is shown a reaction vessel 1, according to the present invention, which is longitudinally divided into a semi-spherical closed bottom portion 2, an elongated mid-portion 3, an enlarged cylindrical collection chamber 4, and a neck portion 5 which terminates in a top opening 6.

Figure 3:
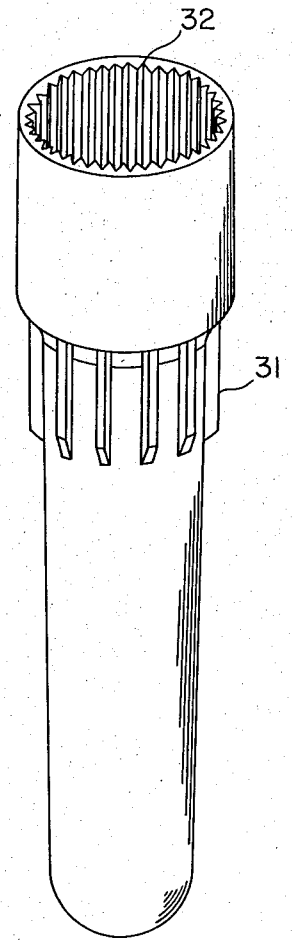
FIG. 3 is a perspective view of a reaction vessel incorporating additional teachings of the present invention than shown in FIG. 1.

Reaction vessels of FIG. 1 and FIG. 3 are molded out of suitable plastics such as polystyrene, polycarbonate, polypropylene and the like. They are normally disposed of after a single use. If convenient, the interior of the vessel may be coated with a specific antibody.

The reaction vessel shown in FIG. or FIG. 3 may also optionally be fabricated to contain a longitudinally extending divider 26 within the interior of the vessel and extending from the interior bottom of the vessel. This divider will provide the interior of the vessel with a left reagent chamber 21, and a right reagent chamber 22. When using this alternative form of vessel 1, it is possible to place a first reactant in one reagent chamber and a second reactant in the second reagent chamber without causing interaction between the reagents. The reaction may then be started by tilting the vessel to allow the reagents in each chamber to mix, or by rapidly spinning the vessel about its longitudinal axis thereby causing the reactants to flow upward along the inside walls of the vessel and to mix during the spinning process.

The vessel 1 contains a collection chamber portion 4 located near the uppermost portion of the vessel. This chamber is formed by an increase in the interior diameter of the vessel between two outwardly extending shoulders 24 and 25. For example, practical interior diameter dimensions of the vessel may be 11.0 mm at the bottom portion 2, 13.0 mm at the mid-portion 3 immediately below shoulder 24, and 11.0 mm at opening 6. The collection chamber may have an interior diameter of 18.0 mm, the increase being brought about by the degree by which shoulders 24 and 25 are outwardly extending. Of course, these specific diameters may vary depending upon the practical considerations in the manufacture and use of individual vessels.

In a contemplated use, the reaction vessel will act as a centrifugation tube spun about its longitudinal axis. If so spun, the contents will be forced towards the wall of the vessel be centrifugal force. As the vessel wall is tapered from a smaller lower diameter to a larger upper diameter the centrifugal force can be separated into two vectors: the major vector perpendicular to the vessel wall and a smaller vector in the upwards direction parallel to the vessel wall. If the latter force exceeds one gravity the tube contents will be transferred entirely to the upper cylindrical portion of the vessel where the heavier solids contained in the fluid will be deposited on the vessel wall. If the upward force vector is less than one gravity the vessel contents will remain entirely in the lower portion, assuming the vessel has not been over filled.

The amount of centrifugal force required to exceed one gravity in the vertical direction is related to the degree of taper in the mid-portion of the vessel, the greater the taper the greater the vertical force vector and the less total centrifugal force required. The centrifugation speed required to achieve that centrifugal force is inversely related to the diameter of the vessel according to the following formula:

$$rcf = 5.585d(rpm/1000)^2$$

In the example with the dimensions given above, assuming a 2 degree taper, a centrifugation speed of over 3000 rpm would be required to force the vessel contents into the upper collection chamber. Thus speeds of up to 2000 rpm could safely be employed for vortex mixing of the vessel contents. To sediment the suspended solids, centrifugation speeds of 10,000 and 15,000 rpm would provide rcf's of 1,000 and 2,200×gravity respectively. An advantage provided by the present reaction vessel is that the low mass permits very high speed spinning to rapidly separate liquid and solid phases. Extremely rapid separation is further enhanced by the short path the solid phase must traverse as it is spinning in an annular ring in the upper portion of the vessel. After cessation of spinning the liquid phase will return to the lower portion of the vessel thus providing complete physical and spacial separation of the liquid and solid phases.

In addition to providing an appropriate means for spinning the vessel about its longitudinal axis, for example a chuck into which vessel 1 may fit, the vessel itself may be so modified, as shown in FIG. 3, to provide means for spinning. Immediately, below the collection chamber, and attached to the lower shoulder of the chamber, it is possible to provide a number of vertically and outwardly extending vanes 31. In this embodiment, a high speed jet of air may be blown tangentially to the vessel and against the vanes 34 which will cause the vessel to spin about its longitudinal axis.

The collection chamber of the reaction vessel shown in FIG. 3 is formed by sealing the opening 6 with metal or plastic film (not shown) which can be punctured for the addition of sample and/or reagents. Alternatively, the opening 6 can be closed with a tight-fitting cap 41. Sealed reaction vessels allow prefilling with specific reagent, either as a solution or in dry form for reconstitution with water or a suitable solvent. A further advantage of the vessel of FIG. 3 is that it can be fabricated with a simple two-piece injection mold. The vessel of FIG. 1 requires a more complex injection blow mold.

The bottom portion of the reaction vessels of FIG. 1 and FIG. 3 can be made with an inverted conical shape 42 to facilitate engagement of the shaft of a motor and also to prevent the formation of a residual drop of fluid at the exact center of the bottom of the vessel where the centrifugal force is zero.

The interior of the collection chamber can be fluted to provide V-grooves 32 for improved retention of precipitates which otherwise might become dislodged by the fluid phase as it returns to the lower section of the vessel on cessation of spinning.

In automated immunoassays, vessels of the present invention are conveyed on a continuous track at precisely timed intervals through a series of processing stations where samples and/or reagents are added, mixing is accomplished by slow speed spinning of the vessel, and separation of bound and unbound antigen by high speed spinning.

The following examples are given in order to further illustrate embodiements of using the present invention. They are in no manner intended to limit the scope of the invention.

EXAMPLE 1

An analysis for amylase in serum, urine, or saliva can easily be performed as follows: a small volume of sample is added to a buffered suspension of dyed starch such as Amylochrome TM (Roche Diagnostics, Nutley NJ) or Phadebas ® Amylase Test (Pharmacia, Piscataway, NJ) in a reaction vessel of FIG. 1. The contents are mixed by brief spinning at low speed. After a timed incubation the vessel is centrifuged at high speed to sediment the unreacted dyed starch and stop the reaction. The amylase activity is determined from the concentration of soluble blue dyed starch fragments in the lower portion of the vessel measured photometrically using recognized protocols.

EXAMPLE 2

Trypsin and other proteolytic enzymes can be quantitated by their action on proteins such as casein. After a timed incubation of sample with a solution of the substrate protein, undigested protein is precipitated with trichloroacetic acid. After centrifugation at high speed to sediment the precipitated undigested substrate in the upper chamber of the vessel, the concentration of soluble peptides in the lower portion is determined from the absorbance of the solution at 280 nm.

EXAMPLE 3

An assay for uric acid in serum using AccUric TM (General Diagnostics, Morris Plains NJ) is performed as follows: 0.1 ml of serum is added to a reaction vessel of FIG. 1 containing 1 ml of phosphotungstic acid reagent. After mixing by slow spinning and allowing to stand for 15 minutes, the precipitated protein is sedimented in the upper chamber by high speed centrifugation. Sodium carbonate reagent (0.5 ml) is added and mixed by slow spinning. The absorbance of the reduced phosphotungstate solution is then read in a spectrophotometer at 700 nm.

EXAMPLE 4

High density lipoproteins are measured as cholesterol in the supernatant solution from serum or plasma after precipitation of other lipoproteins with a polyanion-divalent cation combination, such as heparin, dextran sulphate, or phosphotungstate combined with manganese, magnesium, or calcium ions. With the present invention the precipitated lipoproteins are sedimented in the upper chamber of the reaction vessel and the cholesterol concentration of the supernatant solution is measured with any one of several colorimetric reagents for cholesterol.

EXAMPLE 5

A radioimmunoassay (RIA) is performed by incubating in the lower portion of the vessel rabbit antibody directed against the analyte of interest with a small amount of the same analyte labelled with a radioactive atom such as $^{125}I$. After a timed incubation during which analyte in the same and labelled analyte compete for a limited number of binding sites on the antibody, the antibody along with the bound labelled and unlabelled analyte is precipitated by a mixture of polyethylene glycol (PEG) and goat anti-rabbit gamma globulin. The precipitate is sedimented in the upper chamber by high speed centrifugation after which the radioactivity in either the upper or lower portion of the vessel is counted.

EXAMPLE 6

A fluoresence immunoassay (FIA) is performed in an analogous manner in the RIA in Example 5 except that a fluorescent label such as fluorescein or rhodamine is used instead of a radioactive label. The fluorescence of the solution in the lower portion of the vessel is measured with a fluorimeter.

EXAMPLE 7

An enzyme immunoassay (EIA) is performed in an analogous manner to the RIA in Example 5 except that an enzyme label such as beta glucuronidase is used instead of a radioactive label. The enzymatic activity in the lower portion of the vessel is determined by the addition of suitable substrate and monitoring of the subsequent enzyme reaction.

EXAMPLE 8

An immunoassay is performed by incubating in the lower portion of the vessel a sample such as blood serum with a solution containing an antibody directed against the analyte to be measured which is saturated with analyte labelled with a radioisotope, fluorescent molecule or enzyme as in Examples 5–7. After a timed incubation during which analyte in the sample displaces the labelled analyte bound to the antibody in proportion to the concentration of analyte in the sample, a second reagent such as antibody directed against the specific antibody combined with PEG is added to precipitate all of the specific antibody along with the bound labelled analyte. The vessel is centrifuged at high speed to sediment the antibody with bound labelled analyte in the upper chamber and the label is quantitated in the lower portion of the vessel by suitable instrumentation.

EXAMPLE 9

An immunoassay is performed by incubating in the lower portion of the vessel a sample such as serum with a suspension of antibody directed against the analyte to be measured which is saturated with analyte labelled with a radioisotope, fluorescent molecule, or enzyme as in Examples 5–7 and is coupled or otherwise bound to a solid particle such as Sephadex, latex, or *Staphlococcus aureus.* After a timed incubation during which analyte in the sample displaces the labelled analyte bound to the antibody in proportion to the concentration of analyte in the sample, the vessel is centrifuged at high speed to sediment the suspension of antibody with bound labelled analyte in the upper chamber and the label is quantitated in the lower portion of the vessel by suitable instrumentation.

EXAMPLE 10

An immunoassay is performed by incubating in the lower portion of the vessel for a timed period a sample such as blood serium with an excess of monovalent antibody (F(ab)) directed against the analyte of interest and labelled with a radioisotope, fluorescent molecule, or enzyme. An excess of analyte, insolubilized by, for example, bonding to an inert particle such as Sephadex, is then added. The vessel contents are mixed by slow spinning and incubated briefly during which time all excess labelled antibody, i.e. not bound to analyte in the sample, is reacted. The mixture is then centrifuged at high speed to sediment in the upper chamber the excess label and the label in the lower portion of the vessel, in direct proportion to the concentration of analyte in the sample, is quantitated by suitable instrumentation.

EXAMPLE 11

An immunoassay is performed by incubating in the lower portion of the vessel for a timed period a sample such as blood serum with an excess of the analyte of interest which is coupled to an insoluble particle as in Example 9 and the analyte is also saturated with antibody which has been labelled with a radioisotope fluorescent molecule or enzyme. Analyte in the sample displaces antibody from the insoluble particles in direct proportion to its concentration. The mixture is then centrifuged at high speed to sediment in the upper chamber the undisplaced labelled antibody, and the concentration of displaced labelled antibody in the lower portion is quantitated by suitable instrumentation.

EXAMPLE 12

Immunoassays are performed as in Examples 10 and 11 except that the antibody is labelled with colloidal gold and the concentration of label in the lower portion of the tube is determined either by right-angle light scattering or by measuring the absorbance of the solution at 540 nm.

EXAMPLE 13

An immunoassay is performed by incubating in the lower portion of the vessel, the surface to which has bound to it antibody directed against the analyte of interest, a sample such as blood serum. After a timed incubation during which the vessel can be intermittently spun at slow speed to hasten the reaction between analyte in the sample and the antibody on the vessel, antibody against the same analyte but labelled with a radioisotope is added. After a timed incubation during which the labelled antibody reacts with analyte bound to the first antibody forming a "sandwich" directly proportional to the concentration of analyte, the vessel is centrifuged at high speed and the radioactivity bound to the lower portion of the vessel is counted while the vessel is spinning. This example only applies to analytes such as proteins which have multiple antigenic sites.

EXAMPLE 14

An immunoassay similar to that in Example 13 but applicable to small molecules with only a single antigenic determinant is performed by incubating sample with radiolabelled analyte which then compete for binding sites on the antibody coating the lower portion of the vessel. The radioactivity bound to the lower portion, which is counted while the device is spinning at high speed, is inversely proportional to the concentration of analyte in the sample.

EXAMPLE 15

Figure 2:
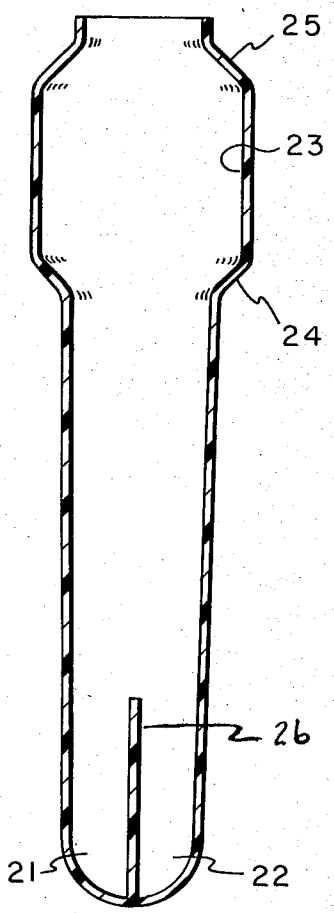
FIG. 2 is a longitudinal cross-sectional view of the reaction vessel of FIG. 1.

A semi-automated method of analysis according to Examples 1–14 is performed by manually adding sample to be assayed to one side of the divided lower portion 21 of the reaction vessel of FIG. 2 and the first reagent involved is added to the other side 22. The timing of the reaction is precisely controlled by automatically initiating the reaction in each vessel by spinning the vessels in turn.

EXAMPLE 16

A fully automated method of analysis according to Examples 1–14 is performed by conveying the reaction vessels on a track or turntable at precisely timed intervals through a series of processing stations where samples and/or reagents are added, mixing is accomplished by slow speed spinning of the vessels, separation of a precipitate or solid phase is accomplished by high speed spinning, and measurement of the analyte in either the solid or liquid phase is accomplished by appropriate means. Thus, while I have illustrated and described the preferred embodiments of my invention, it is to be understood that this invention is capable of variation and modification, and I therefore do not wish to be limited to the precise terms set forth, but desire to avail myself of such changes and alterations which may be made for adapting the invention to various usages and conditions. Accordingly, such changes and alterations are properly intended to be within the full range of equivalents, and therefor within the purview, of the following claims.

Having thus described my invention and the manner and process of making and using it, in such full, clear, concise, and exact terms so as to enable any person skilled in the art to which it pertains, or with which it is most nearly connected, to make and use the same;

I claim:

1. A vessel of single construction comprising in longitudinal order about a center axis (1) a closed bottom portion; (2) generally cylindrical mid-portion having a predetermined interior diameter somewhat narrower at the bottom-most portion than at the top-most portion of said mid-portion; (3) a chamber portion comprising an outwardly biased lower portion, a generally cylindrical middle portion of greater interior diameter than said mid-portion, and an inwardly biased upper portion; and (4) a neck portion having an interior diameter less than the interior diameter of said chamber middle portion.

2. A method of separating a liquid phase from a solid phase which comprises (A) placing the mixture to be separated in a vessel according to claim 1; (B) rotating the vessel about its longitudinal axis with sufficient speed to cause the solid phase to be deposited in the chamber portion of said vessel by centrifugal force; and (C) recovering the liquid phase in the mid-portion and bottom portion of said vessel.

3. A method of analysis in which the reactant or product of reaction is insoluble and is separated from the liquid phase of the reaction mixture according to the method of claim 2.

4. A method of analysis in which a sample comprising antigen or antibody to be analyzed is mixed with a known amount of similar antigen or antibody carrying a suitable label, the the label is partitioned between a soluble and an insoluble phase depending upon the concentration of analyte in the sample, the phases are separated by the method of claim 2, and the label is quantitated by suitable means.

5. A method according to claim 4 wherein the label is a radioactive isotope.

6. A method according to claim 4 wherein the label is a fluorescent molecule.

7. A method according to claim 4 wherein the label is an enzyme.

8. A method according to claim 4 wherein the label is colloidal gold.

9. The vessel of claim 1 wherein the closed bottom portion is adapted to reversibly engage the shaft of a motor.

10. The vessel of claim 1 wherein the mid-portion is a truncated cone.

11. A vessel according to claim 1 wherein the vessel further comprises a longitudinal partition separating the said closed bottom portion and the lower portion of the said mid-portion into two discrete chambers.

12. A vessel of single construction comprising in longitudinal order about a central axis, a closed bottom portion; a generally cylindrical mid-portion having a predetermined interior diameter somewhat narrower at the bottom portion that at the top portion thereof; a chamber portion comprising an outwardly biased lower portion, a generally cylindrical upper portion of greater interior diameter than said mid-portion, and terminating in a generally circular uppermost portion open to the environment; said vessel further having means on the outer surface of said vessel to allow for the spinning of the vessel on its longitudinal axis.

13. The vessel of claim 12 wherein the closed bottom portion is adapted to reversibly engage the shaft of a motor.

14. The vessel of claim 12 wherein the mid-portion is a truncated cone.

15. The vessel of claim 12 wherein the interior surface of the chamber portion is fluted longitudinally with small grooves.

16. The vessel of claim 12 wherein the top portion is selectively closed by a film of plastic or metal foil.

17. A method of separating a liquid phase from a solid phase which comprises (A) placing the mixture to be separated in a vessel according to claim 16; rotating the vessel about its longitudinal axis with sufficient speed to cause the solid phase to be deposited in the chamber portion of said vessel by centrifugal force; and (C) recovering the liquid phase in the mid-portion and bottom portion of said vessel.

18. A method of analysis in which a sample comprising antigen or antibody to be analyzed is mixed with a known amount of similar antigen or antibody carrying a suitable label, the label is partitioned between a soluble and an insoluble phase depending uopn the concentration of analyte in the sample, the phases are separated by the method of claim 17, and the label is quantitated by suitable means.

19. The vessel of claim 12 wherein the top portion is selectively closed by a tight fitting cap.

20. The vessel according to claim 12 wherein said means are vanes extending downwardly from said outwardly biased lower portion.

* * * * *